US010339912B1

(12) United States Patent
Cai et al.

(10) Patent No.: US 10,339,912 B1
(45) Date of Patent: Jul. 2, 2019

(54) ACTIVE NOISE CANCELLATION SYSTEM UTILIZING A DIAGONALIZATION FILTER MATRIX

(71) Applicant: HARMAN INTERNATIONAL INDUSTRIES, INCORPORATED, Stamford, CT (US)

(72) Inventors: Tingli Cai, Ann Arbor, MI (US); Markus E. Christoph, Straubing (DE)

(73) Assignee: Harman International Industries, Incorporated, Stamford, CT (US)

( * ) Notice: Subject to any disclaimer, the term of this patent is extended or adjusted under 35 U.S.C. 154(b) by 75 days.

(21) Appl. No.: 15/915,941

(22) Filed: Mar. 8, 2018

(51) Int. Cl.
*G10K 11/178* (2006.01)

(52) U.S. Cl.
CPC .. *G10K 11/17815* (2018.01); *G10K 11/17854* (2018.01); *G10K 11/17881* (2018.01); *G10K 2210/1282* (2013.01); *G10K 2210/3026* (2013.01); *G10K 2210/3028* (2013.01); *G10K 2210/3044* (2013.01); *G10K 2210/3046* (2013.01)

(58) Field of Classification Search
CPC ..... G10K 11/1788; G10K 2210/3055; G10K 2210/1282; G10K 2210/3027; G10K 2210/128; G10K 2210/3221; G10K 2210/3053; G10K 2210/503; G10K 2210/506
See application file for complete search history.

(56) References Cited

U.S. PATENT DOCUMENTS 5,953,428 A * 9/1999 Silverberg ..... G10K 11/178 381/71.14
6,275,592 B1 * 8/2001 Vartiainen ..... G10K 11/178 381/71.11
8,135,140 B2 * 3/2012 Shridhar ..... G10K 11/17885 381/71.14
8,199,924 B2 * 6/2012 Wertz ..... G10K 11/178 381/71.1
9,100,747 B2 * 8/2015 Murata ..... H04R 1/1083
9,240,176 B2 * 1/2016 Tzirkel-Hancock ..... G10K 11/002
9,338,554 B2 5/2016 Christoph
(Continued)

FOREIGN PATENT DOCUMENTS

EP 2629289 A1 * 8/2013 ..... G10K 11/178

*Primary Examiner* — Mohammad Islam
(74) *Attorney, Agent, or Firm* — Brooks Kushman P.C.

(57) ABSTRACT

Estimated output signals of the reference signals are generated using an estimated filter path transfer function that provides an estimated effect on sound waves traversing a physical path, the estimated filter path transfer function performing processing according to a diagonalization matrix and reference signals. Anti-noise signals are generated from the reference signals using an adaptive filter driven by learning unit signals received from a learning algorithm unit, the learning unit signals based in part on error output signals generated from the estimated output signals, the anti-noise signals including signals per sound zone and per reference signal, each sound zone including a microphone and one or more loudspeakers. A sum across references is performed on the anti-noise signals to generate a set of output signals per sound zone. The set of output signals are processed by the diagonalization matrix to generate a set of output signals per loudspeaker.

18 Claims, 5 Drawing Sheets

(56) References Cited

U.S. PATENT DOCUMENTS

| | | | | |
|---|---|---|---|---|
| 9,357,304 | B2 | 5/2016 | Christoph | |
| 9,824,678 | B1 * | 11/2017 | Ou | G10K 11/178 |
| 10,034,092 | B1 * | 7/2018 | Nawfal | H04R 5/04 |
| 2005/0207585 | A1 * | 9/2005 | Christoph | G10K 11/178 381/71.11 |
| 2008/0181422 | A1 * | 7/2008 | Christoph | G10K 11/17817 381/73.1 |
| 2009/0086990 | A1 * | 4/2009 | Christoph | H04R 3/04 381/71.12 |
| 2010/0195844 | A1 * | 8/2010 | Christoph | G10K 11/178 381/71.11 |
| 2010/0272283 | A1 * | 10/2010 | Carreras | G10K 11/178 381/71.6 |
| 2011/0206214 | A1 * | 8/2011 | Christoph | G10K 11/1784 381/71.6 |
| 2012/0093344 | A1 * | 4/2012 | Sun | H04R 3/005 381/122 |
| 2013/0259251 | A1 * | 10/2013 | Bakalos | H04R 1/1083 381/71.8 |
| 2015/0010164 | A1 * | 1/2015 | Christoph | G10K 11/178 381/71.6 |
| 2016/0029124 | A1 * | 1/2016 | Paranjpe | H04M 9/082 381/71.14 |
| 2016/0300563 | A1 * | 10/2016 | Park | G10K 11/17853 |
| 2017/0077906 | A1 * | 3/2017 | Argyropoulos | H03H 21/0012 |
| 2017/0178617 | A1 * | 6/2017 | Christoph | G10K 11/1786 |
| 2017/0287462 | A1 * | 10/2017 | Christoph | G10K 11/1788 |
| 2017/0301336 | A1 * | 10/2017 | Kumar | G10K 11/1788 |

* cited by examiner

ACTIVE NOISE CANCELLATION SYSTEM UTILIZING A DIAGONALIZATION FILTER MATRIX

TECHNICAL FIELD

Aspects of the disclosure generally relate to active noise cancellation systems utilizing a diagonalization filter matrix.

BACKGROUND

Active noise cancellation (ANC) may be used to generate sound waves or anti-noise that destructively interferes with undesired sound waves. Potential sources of undesired noise may come from undesired voices, heating, ventilation, and air conditioning systems and other environment noise in a room listening space. Potential sources may also come from vehicle engine, tire interaction with the road and other environment noise in a vehicle cabin listening space. ANC systems may use feedforward and feedback structures, to adaptively formulate anti-noise signals. Sensors placed near the potential sources provide the reference signals for the feedforward structure. Sensors placed near the listeners' ear positions provide the error signals for the feedback structure. Once formulated, the destructively-interfering anti-noise sound waves may be produced through loudspeakers to combine with the undesired sound waves in an attempt to cancel the undesired noise. Combination of the anti-noise sound waves and the undesired sound waves can eliminate or minimize perception of the undesired sound waves by one or more listeners within a listening space.

Sound zones may be generated using speaker arrays and audio processing techniques providing acoustic isolation. Using such a system, different sound material may be delivered in different zones with limited interfering signals from adjacent sound zones. In order to realize the sound zones, a system may be designed using learning algorithm to adjust the response of multiple sound sources to approximate the desired sound field in the reproduction region.

SUMMARY

In one or more illustrative examples, an active noise cancellation system uses a diagonalization matrix to process anti-noise signals. The system realizes sound zones, each including one or more microphones and one or more loudspeakers. The system includes a diagonalization matrix, which is designed offline, to realize the sound zones. The system further includes an audio processor programmed to generate anti-noise signals for each sound zone, based on the reference signals and feedback signals, through an adaptive filter system, using an estimated acoustic transfer function that provides an estimated effect on sound waves traversing the physical path. The adaptive filters are driven by a learning algorithm unit. The learning algorithm unit is based in part on the feedback error signals, the reference signals, and the filtered reference signals by the estimated acoustic transfer functions combined with the diagonalization matrix. The anti-noise signals include signals per sound zone. The system performs a sum across filtered references on the adaptive filter output signals, to generate a set of anti-noise signals per sound zone; processes the set of anti-noise signals using a diagonalization matrix to generate a set of output signals per loudspeaker; and drives the loudspeakers with the output signals per loudspeaker to apply the anti-noise signals to cancel the environmental noise in each zone.

In one or more illustrative examples, an active noise cancellation method, using a diagonalization matrix, performs cancelling of environmental noise. Estimated output signals of the reference signals are generated using an estimated filter path transfer function that provides an estimated effect on sound waves traversing a physical path, the estimated filter path transfer function performing processing according to a diagonalization matrix and reference signals. Preliminary anti-noise signals are generated from the reference signals using an adaptive filter driven by learning unit signals received from a learning algorithm unit. The learning unit signals are based in part on error output signals generated from the estimated output signals. The anti-noise signals include signals per sound zone and per reference signal. Each sound zone includes a microphone and one or more loudspeakers. A sum across references is performed on the preliminary anti-noise signals to generate a set of output signals per sound zone. The set of output signals are processed by the diagonalization matrix to generate a set of output signals per loudspeaker. The loudspeakers are driven using the output signals per loudspeaker to apply the anti-noise signals to cancel the environmental noise.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Traditionally, active noise cancellation systems use Least Means Square (LMS)-based algorithms, such as Filtered-x Least Means Square (FxLMS) or other variants. Such schemes require a large amount of input channels of reference and feedback microphone signals, as well as a large amount of output channels of speakers. Traditional algorithms usually employ a large filter system, which is adaptive in operation. The performance of noise cancellation relies on the convergence of the entire filter system. Due to the complex acoustic environment and highly limited adaptation time, optimal convergence is usually difficult to achieve, which leads to unsatisfying performance.

This disclosure combines an active noise cancellation (ANC) system with a diagonalization filter matrix. This combination simplifies cabin acoustic management by diagonalizing a speaker-to-microphone transfer function matrix of the ANC. By combining the diagonalization matrix with ANC, the disclosure separates the noise cancellation effort into (i) offline acoustic tuning, i.e., designing of the diagonalization filter matrix, and (ii) real-time adaptation of the decoupled, simplified ANC filter system. Thus, using the diagonalization matrix to cut down the computational complexity, the system yields a faster convergence rate and improves the cancellation performance.

Figure 1:
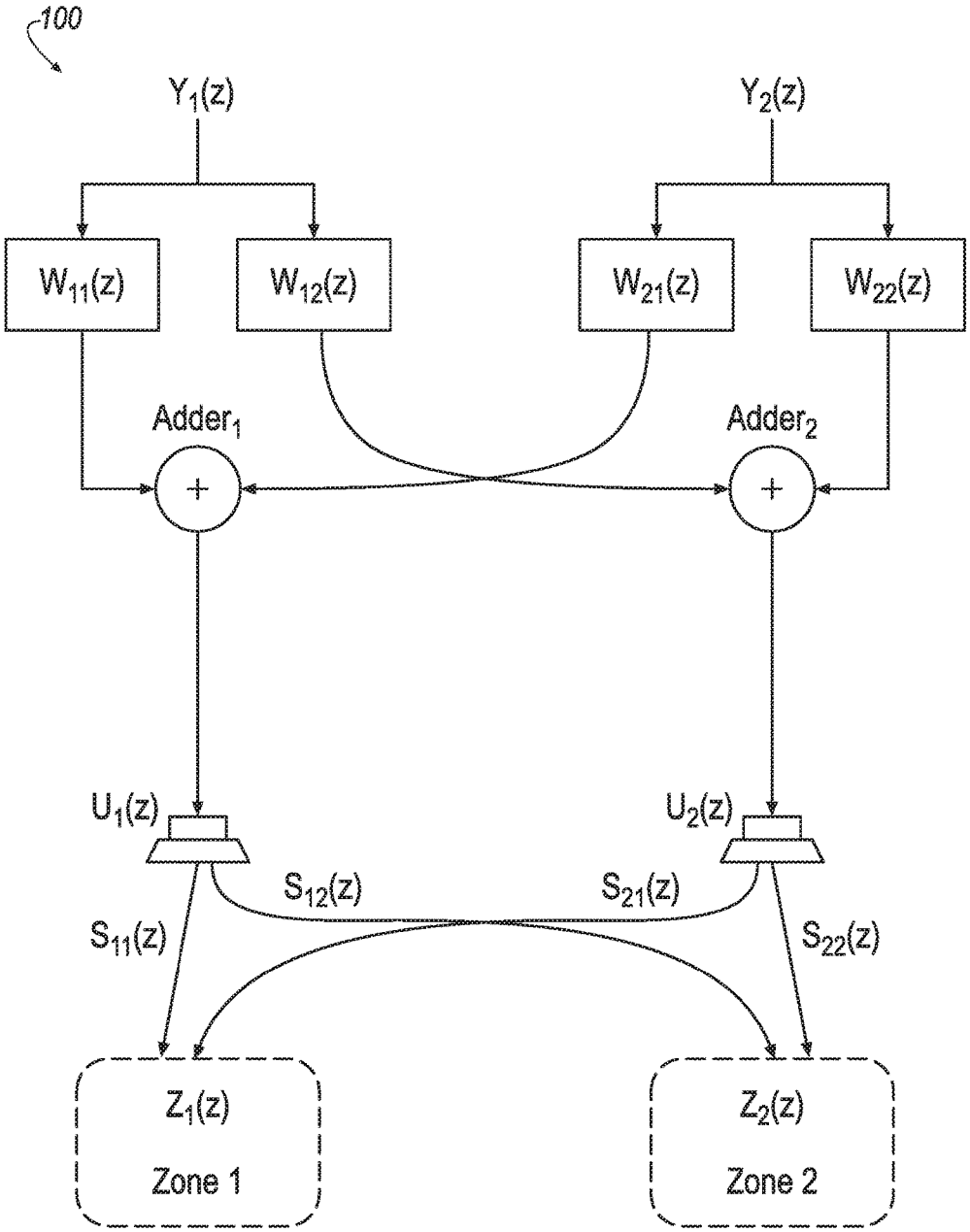
FIG. 1 illustrates an example sound system including two sound zones.

FIG. 1 illustrates an example system 100 including two sound zones. Sound zones may be implemented in various settings, such as for different seating positions in a vehicle interior. In the depicted system 100, the audio signals and transfer functions are frequency domain signals and functions, which have corresponding time domain signals and functions, respectively. The first sound zone input audio signal $Y_1(z)$ is intended for reproduction in the first sound zone $Z_1(z)$, while the second sound zone input audio signal $Y_2(z)$ is intended for reproduction in the second sound zone $Z_2(z)$. Notably, the illustrated sound zone system is a one-way system, without feedback. It should be noted that the illustration of two sound zones is provided as a minimal version for ease of explanation, and systems having a greater number of sound zones may be used.

In the illustrated example, the input audio signals $Y_1(z)$ and $Y_2(z)$ are pre-filtered by inverse filters $\check{W}_{11}(z)$, $\check{W}_{12}(z)$, $\check{W}_{21}(z)$, and $\check{W}_{22}(z)$. The filter output signals are combined as illustrated in FIG. 1. Specifically, the signal $U_1(z)$ supplied to the first loudspeaker can be expressed as:

$$U_1(z)=\check{W}_{11}(z)\cdot Y_1(z)+\check{W}_{21}(z)\cdot Y_2(z) \tag{1}$$

and the signal $U_2(z)$ supplied to the second loudspeaker can be expressed as:

$$U_2(z)=\check{W}_{12}(z)\cdot Y_1(z)+\check{W}_{22}(z)\cdot Y_2(z) \tag{2}$$

The first loudspeaker radiates the signal $U_1(z)$ as an acoustic signal that traverses through the physical paths $S_{11}(z)$ and $S_{12}(z)$ and arrives in the first sound zone and the second sound zone, respectively. The second loudspeaker radiates the signal $U_2(z)$ as an acoustic signal that traverses through the physical paths $S_{21}(z)$ and $S_{22}(z)$ and arrives in the first sound zone and the second sound zone, respectively. Ideally, the sound signals actually present within the two sound zones are denoted as $Z_1(z)$ and $Z_2(z)$, respectively, wherein:

$$Z_1(z)=H_{11}(z)\cdot Y_1(z)+H_{21}(z)\cdot Y_2(z) \tag{3}$$

and $$Z_2(z)=H_{12}(z)\cdot Y_1(z)+H_{22}(z)\cdot Y_2(z) \tag{4}$$

In Equations 3 and 4, the transfer function $H_{11}(z)$ denotes overall system transfer function in the frequency domain, i.e., the combination of the diagonalization filters $\check{W}_{11}(z)$, $\check{W}_{12}(z)$, $\check{W}_{21}(z)$, and $\check{W}_{22}(z)$ and the room transfer functions $S_{11}(z)$, $S_{21}(z)$, $S_{12}(z)$ and $S_{22}(z)$. Ideally, $H_{12}(z)$ and $H_{21}(z)$ are equal to 0.

The above equations 1-4 may also be written in matrix form, wherein equations 1 and 2 may be combined into:

$$U(z)=\check{W}(z)Y(z) \tag{5}$$

and $$Z(z)=S(z)U(z) \tag{6}$$

wherein $Y(z)$ is a vector composed of the input signals, i.e., $Y(z)=[Y_1(z), Y_2(z)]^T$, $U(z)$ is a vector composed of the loudspeaker signals, i.e., $U(z)=[U_1(z), U_2(z)]^T$, $\check{W}(z)$ is a 2×2 matrix representing the diagonalization filter transfer functions $$\check{W}(z)=\begin{bmatrix}\check{W}_{11}(z) & \check{W}_{21}(z)\\ \check{W}_{12}(z) & \check{W}_{22}(z)\end{bmatrix},$$

and $S(z)$ is a 2×2 matrix representing the room impulse responses in the frequency domain $$S(z)=\begin{bmatrix}S_{11}(z) & S_{21}(z)\\ S_{12}(z) & S_{22}(z)\end{bmatrix}.$$

Combining equations 5 and 6 yields:

$$Z(z)=S(z)\check{W}(z)Y(z) \tag{7}$$

From the above equation 7, it can be seen that if:

$$\check{W}(z)=S^{-1}(z)\cdot z^{-N} \tag{8}$$

i.e., when the filter matrix $\check{W}(z)$ is equal to the inverse of the room impulse response matrix, $S^{-1}(z)$ plus an additional delay of N samples (which represents at least the acoustic delay), then the acoustic signal arriving in the first zone $Z_1(z)$ equals the first sound zone signal $Y_1(z)$, and the acoustic signal arriving in the second zone $Z_2(z)$ equals the second sound zone signal $Y_2(z)$, although delayed by the delay of N samples as compared to the input signals. That is:

$$Z(z)=I(z)Y(z)\cdot z^{-N}=Y(z)\cdot z^{-N} \tag{9}$$

wherein $I(z)\cdot z^{-N}=S(z)\ \check{W}(z)$ and $I(z)$ is the 2×2 identity matrix.

Thus, designing a sound zone reproduction system is, from a mathematical point of view, an issue of inverting the transfer function matrix $S(z)$, which represents the room impulse responses in the frequency domain, i.e., an issue of diagonalizing the overall system transfer function matrix by designing the diagonalization matrix $\check{W}(z)$. This computation can be performed offline, before the zone sound reproduction system is used. Various methods are known for matrix inversion. For example, the inverse of a square matrix may be theoretically determined as follows:

$$\check{W}(z)=det(S)^{-1}\cdot adj(S(z)), \tag{10}$$

which is a consequence of Cramer's rule applied to equation 8 (the delay is neglected in equation 10). The expression $adj(S(z))$ represents the adjugate matrix of the square matrix $S(z)$. One can see that the pre-filtering may be done in two stages, wherein the filter transfer function $adj(S(z))$ ensures a damping of the crosstalk and the filter transfer function $det(S)^{-1}$ compensates for the linear distortions caused by transfer function $adj(S(z))$. The adjugate matrix $adj(S(z))$ results in a causal filter transfer function, whereas a compensation filter $G(z)=det(S)^{-1}$ may be more difficult to design. Nevertheless, several known methods for inverse filter design may be appropriate. Further aspects of designing of the filter matrix is demonstrated in the Individual Sound Zone (ISZ) functionality described in detail in detail in U.S. Patent Publication No. 2015/350805, titled "Sound wave field generation," which is incorporated by reference herein in its entirety.

Figure 2:
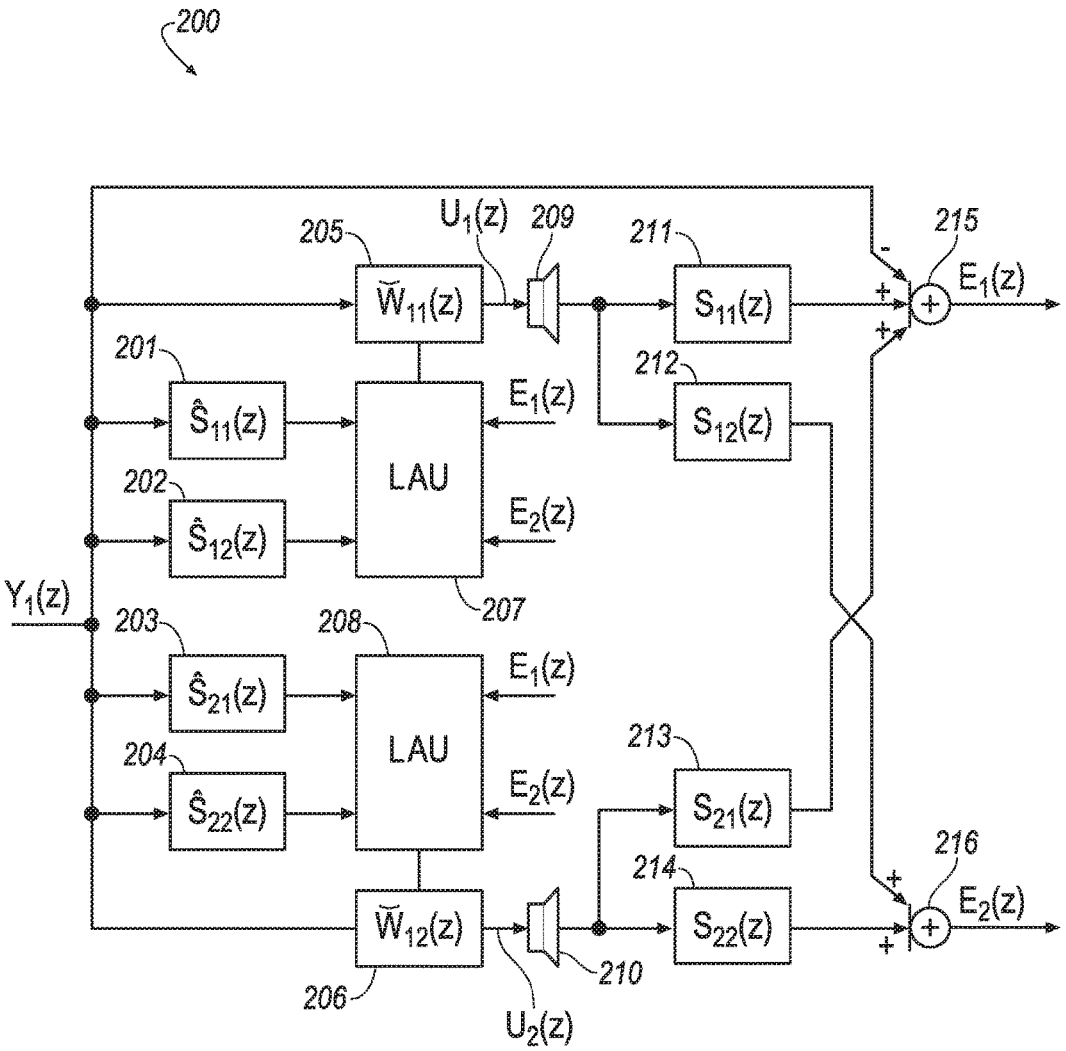
FIG. 2 illustrates an example half signal flow of a system for tuning the $\check{w}$ filter matrices of FIG. 1.

FIG. 2 illustrates an example 200 half signal flow of a system for tuning the $\check{W}$ diagonalization filter matrices of FIG. 1. For instance, the details shown in FIG. 2 correspond to the filtering performed for the processing of the input signal $Y_1(z)$. Generally, the illustrated system receives the input signal $Y_1(z)$, and processes the signal $Y_1(z)$ using the filter matrices $\check{W}_{11}(z)$ and $\check{W}_{12}(z)$ to generate the loudspeaker signals $U_1(z)$ and $U_2(z)$. $U_1(z)$ traverses through the physical paths $S_{11}(z)$ and $S_{12}(z)$ and arrives in the first sound zone and the second sound zone, respectively. Similarly, $U_2(z)$ traverses through the physical paths $S_{21}(z)$ and $S_{22}(z)$ and arrives in the first sound zone and the second sound zone, respectively. After mixed acoustically and received by the microphones, the output of the microphone 215 is further compared to the input signal $Y_1(z)$ to generate the error signal $E_1(z)$, and the output of the microphone 216 is used to generate the error signal $E_2(z)$. By adjusting $\check{W}_{11}(z)$ and $\check{W}_{12}(z)$, the error signals $E_1(z)$ and $E_2(z)$ are minimized, respectively, such that $Y_1(z)$ is reproduced in the first sound zone, and minimized in the second sound zone. A similar signal flow may additionally be provided for the processing of the input signal $Y_2(z)$ according to the filter matrices $\check{W}_{21}(z)$ and $\check{W}_{22}(z)$ to have $Y_2(z)$ reproduced in the second sound zone, and minimized in the first sound zone.

More specifically, the input signal $Y_1(z)$ is supplied to four filters 201-204, which form a 2×2 matrix of modeled acoustic transfer functions $\hat{S}_{11}(z)$, $\hat{S}_{12}(z)$, $\hat{S}_{21}(z)$ and $S_{22}(z)$, and to two filters 205 and 206, which form a filter matrix comprising $\check{W}_{11}(z)$ and $\check{W}_{12}(z)$. Filters 205 and 206 are controlled by learning units 207 and 208, whereby the learning unit 207 receives signals from filters 201 and 202 and error signals $E_1(z)$ and $E_2(z)$, and the learning unit 208 receives signals from filter 203 and 204 and error signals $E_1(z)$ and $E_2(z)$. Filters 205 and 206 provide signals $U_1(z)$ and $U_2(z)$ for loudspeakers 209 and 210.

The signal $U_1(z)$ is radiated by a first loudspeaker 209 via acoustic paths 211 and 212 to microphones 215 and 216, respectively. The signal $U_2(z)$ is radiated by a second loudspeaker 210 via acoustic paths 213 and 214 to the microphones 215 and 216, respectively. The microphones 215 and 216 respectively generate the error signals $E_1(z)$ and $E_2(z)$ based on the received signals and the desired signal $Y_1(z)$. The filters 201-204 with the transfer functions $\hat{S}_{11}(z)$, $\hat{S}_{12}(z)$, $\hat{S}_{21}(z)$ and $\hat{S}_{22}(z)$ model the various acoustic paths 211-214, which have respective transfer functions $S_{11}(z)$, $S_{12}(z)$, $S_{21}(z)$ and $S_{22}(z)$. It should be noted that while the illustrated example 200 includes one microphone per sound zone, other tuning systems may be implemented that utilize multiple microphones per sound zone to improve accuracy.

Figure 3:
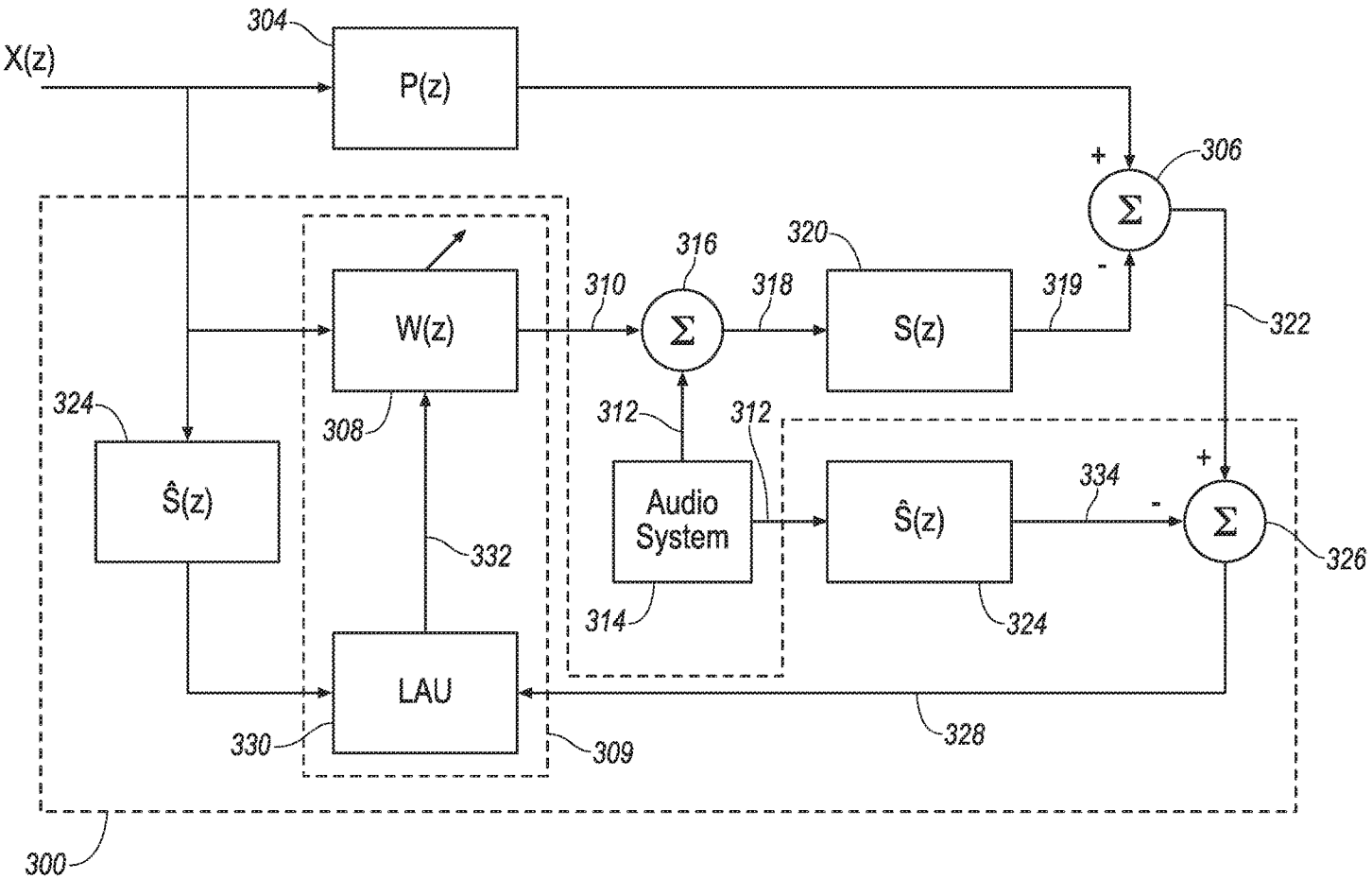
FIG. 3 illustrates an example ANC system and an example physical environment.

FIG. 3 illustrates an example ANC system 300 and an example physical environment. In the ANC system 300, an undesired noise source X(z) may traverse a physical path 304 to a microphone 306. The physical path 304 may be represented by a frequency domain transfer function P(z), which is unknown. The resultant undesired noise, due to traversal of the noise over the physical path 304, may be referred to as P(z)X(z). X(z) may be measured using a sensor and acquired through use of an analog-to-digital (A/D) converter. The undesired noise source X(z) may also be used as an input to an adaptive filter 308, which may be included in an anti-noise generator 309. The adaptive filter 308 may be represented by a frequency domain transfer function W(z). The adaptive filter 308 may be a digital filter configured to be dynamically adapted to filter an input to produce a desired anti-noise signal 310 as an output.

The anti-noise signal 310 and an audio signal 312 generated by an audio system 314 may be combined to drive a loudspeaker 316. The combination of the anti-noise signal 310 and the audio signal 312 may produce the sound wave output from the loudspeaker 316. (The loudspeaker 316 is represented by a summation operation in FIG. 3, having a speaker output 318.) The speaker output 318 may be a sound wave that traverses through a physical path 320 that includes a path from the loudspeaker 316 to the microphone 306. The physical path 320 may be represented in FIG. 3 by a frequency domain transfer function S(z). The speaker output 318 and the undesired noise may be received by the microphone 306 and a microphone output signal 322 may be generated by the microphone 306. In other examples, any number of loudspeakers and microphones may be present.

A component representative of the audio signal 312 may be removed from the microphone output signal 322, through processing of the microphone output signal 322. The audio signal 312 may be processed to reflect the traversal of the physical path 320 by the sound wave of the audio signal 312. This processing may be performed by estimating the physical path 320 as a modeled acoustic path filter 324, which provides an estimated effect on an audio signal sound wave traversing the physical path 320. The modeled acoustic path filter 324 is configured to simulate the effect on the sound wave of the audio signal 312 of traveling through the physical path 320 and generate an output signal 334. In FIG. 3, the modeled acoustic path filter 324 may be represented as a frequency domain transfer function $\hat{S}(z)$.

The microphone output signal 322 may be processed such that a component representative of the audio output signal 334 is removed as indicated by a summation operation 326. This may occur by inverting the filtered audio signal at the summation operation 326 and adding the inverted signal to the microphone output signal 322. Alternatively, the filtered audio signal could be subtracted or any other mechanism or method to remove the signal could be used. The output of the summation operation 326 is an error signal 328, which may represent an audible signal remaining after any destructive interference between the anti-noise signal 310 projected through the loudspeaker 316 and the undesired noise sound originated from X(z). The summation operation 326 removing a component representative of the audio output signal 334 from the microphone output signal 322 may be considered as being included in the ANC system 300.

The error signal 328 is transmitted to a real-time learning algorithm unit (LAU) 330, which may be included in the anti-noise generator 309. The LAU 330 may implement various learning algorithms, such as least mean squares (LMS), recursive least mean squares (RLMS), normalized least mean squares (NLMS), or any other suitable learning algorithm. The LAU 330 also receives as an input the undesired noise source X(z) filtered by the modeled acoustic path filter 324. A LAU output 332 may be an update signal transmitted to the adaptive filter 308. Thus, the adaptive filter 308 is configured to receive the undesired noise source X(z) and the LAU output 332. The LAU output 332 is transmitted to the adaptive filter 308 in order to more accurately cancel the undesired noise source X(z) by providing the anti-noise signal 310.

ANC schemes such as described in FIG. 3 require a large amount of input channels of noise source reference and feedback microphone signals, as well as a large amount of output channels of speakers. Moreover, the performance of noise cancellation relies on the convergence of the entire filter system. Due to the complex cabin acoustic environment and highly limited adaptation time, optimal convergence is usually difficult to achieve, which leads to unsatisfying performance.

In such implementations, facing complex cabin acoustic environment, full real-time adaptive algorithms suffer from adaptation time inadequacy and computation resource limits. Such systems, therefore, do not usually produce the optimal solution and leads to unsatisfying cancellation performance.

Moreover, due to the fully-coupled adaptive filter system W(z), performance of ANC systems such as that shown in FIG. 3 are sensitive to all microphone 306 inputs. Failure of one microphone 306 may cause performance degradation in the particular seat/zone associated with the failed microphone 306. It may also create performance variation in other seats/zones, as the system tries to adapt to the next possible optimal solution with less input information.

Figure 4:
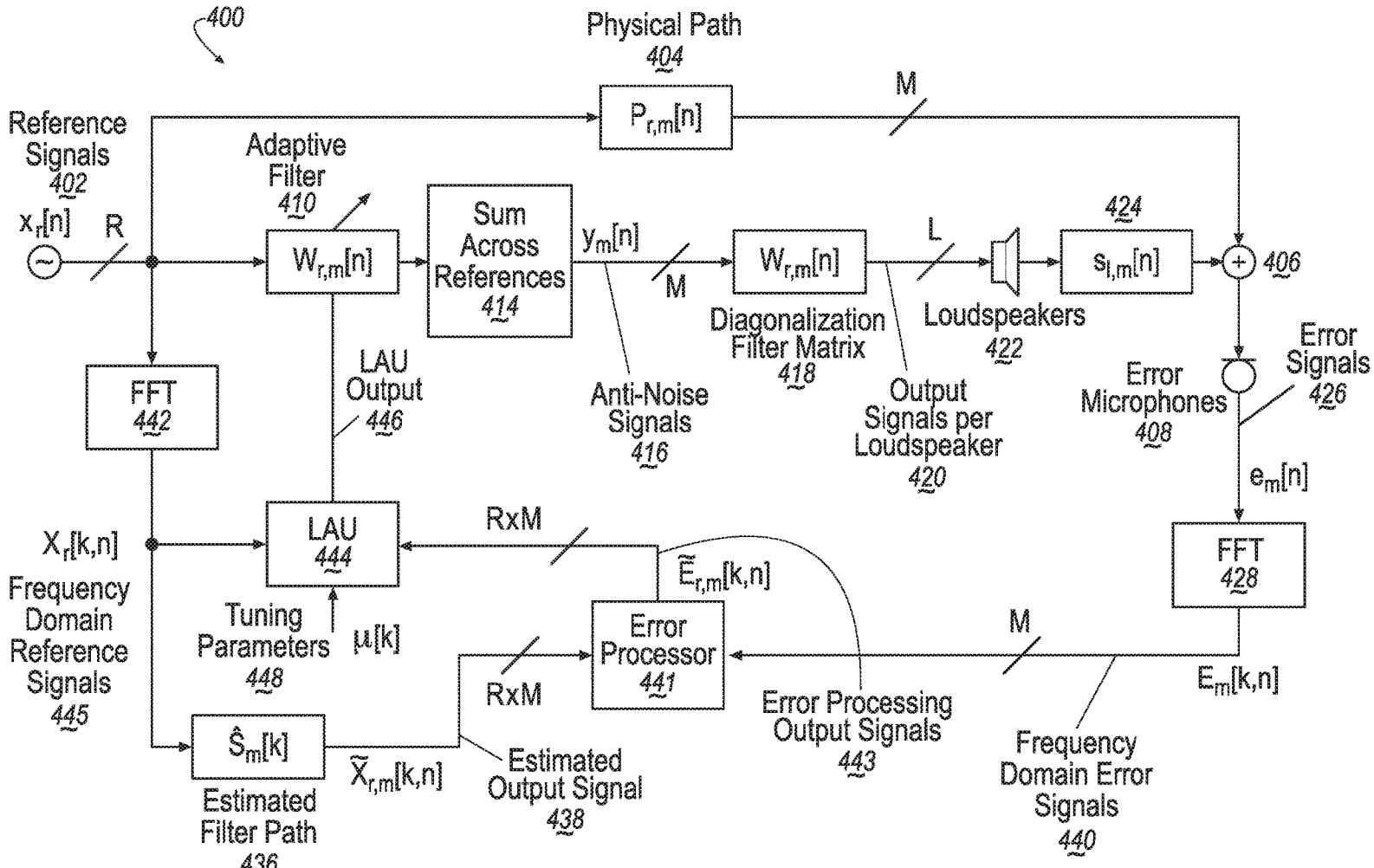
FIG. 4 illustrates an example multichannel ANC system using a diagonalization filter matrix to perform ANC in terms of sound zones.

FIG. 4 illustrates an example multichannel ANC system 400 using a diagonalization filter matrix 418 to perform ANC in terms of sound zones. As a convention in the system 400, let L be the number of loudspeakers, M be the number of microphones and seating zones, R be the number of reference signals (e.g., channels of measured noise source), [k] be the $k^{th}$ sample in frequency domain, and [n] be the $n^{th}$ sample or $n^{th}$ frame in time domain. As explained in further detail below, the multichannel ANC system 400 may operate in a manner similar to the ANC system 300 as described with regard to FIG. 3, but using the sound zone concepts as described with regard to FIGS. 1-2 to reduce system processing requirements.

More specifically, the R reference signals 402 indicate sensed signals that is physically close to sources of noise, and that traverse a physical path 404. Because the reference signals 402 are close to the sources, they may offer a signal that is leading in time. The reference signals 402 may be noted as $x_r[n]$, where r=1 . . . R, as a vector of dimension R, representing the time-dependent reference signals 402 in the time domain. The physical path 404 may be noted as $p_{r,m}[n]$, where r=1 . . . R and m=1 . . . M, as a matrix of R×M, representing the time-dependent transfer functions of the primary paths in the time domain. As discussed in more detail below, the noises originated from the reference signals 402 along with sounds from the loudspeakers 422 are combined in the air 406 and received by M error microphones 408.

The R reference signals 402 may also be input to an adaptive filter 410, which may be a digital filter configured to dynamically adapt to filter the reference signals 402 to produce a desired, anti-noise signal 416 as output after a sum across references 414. The adaptive filter 410 may use the notation $w_{r,m}[n]$, representing the time dependent adaptive w-filters in time domain, where r=1 . . . R and m=1 . . . M, giving a matrix of R×M. As indicated by its name, the adaptive filter 410 changes instantaneously, adapting in time to perform the adaptive function of the ANC system 400.

The outputs of the adaptive filter 410 may be provided to the sum across references 414 combiner. The sum across references 414 may provide the anti-noise signal 416, with M outputs in the form of $y_m[n]$, where m=1 . . . M, representing the time dependent anti-noise signals in the time domain per microphone.

However, as the anti-noise signal 416 include a set of M signals, one per error microphone 408, the anti-noise signal 416 require translation in order to be provided to the L loudspeakers 422. The anti-noise signal 416 may, accordingly, be provided to the diagonalization filter matrix 418, which may translate the M anti-noise signal 416 into L output signals per loudspeaker 420. The diagonalization filter matrix 418 may utilize the notation $\check{w}w_{m,l}[n]$, where m=1 . . . M and l=1 . . . L, giving a matrix of M×L, representing the time independent, off-line trained, diagonalization filters in time domain. Notably, the diagonalization filter matrix 418 is preprogrammed such as described above with respect to the training done in FIG. 2. In contrast to the adaptive filter 410, the diagonalization filter matrix 418 is fixed and does not adjust during operation of the ANC system 400. The output signals per loudspeaker 420 may be referenced in the form of $y_1[n]$, where l=1 . . . L, representing the time-dependent speaker input signals in the time domain.

The 418 output signals per loudspeaker 420 may be applied to the inputs to the loudspeakers 422. Based on the signals per loudspeaker 420, the loudspeakers 422 may, accordingly, produce speaker outputs as acoustical sound waves that traverse an acoustic physical path 424 from the loudspeakers 422 via the air 406 to the error microphones 408. The physical path 424 may be represented by the transfer function $s_{l,m}[n]$, where l=1 . . . L and m=1 . . . M, creating a matrix of L×M, representing the time dependent transfer functions of the acoustic paths in the time domain.

Thus, both the R reference signals 402 traversing the primary physical path 404 and the speaker outputs traversing the acoustic physical path 424 are combined in the air 406 to be received by the M error microphones 408. The M error microphones 408 may generate M error signals 426. The error signals 426 may be referenced in the form $e_m[n]$, where m=1 . . . M, the vector of dimension M, representing the error microphone signals in time domain.

A Fast Fourier Transform (FFT) 428 may be utilized to convert the error signals 426 into frequency domain error signals 440. The frequency domain error signals 440 may be referenced as $E_m[k,n]$, where m=1 . . . M, vector of dimension M, representing the time dependent error microphone signals in the frequency domain.

The R reference signals 402 may also be input to a FFT 442, thereby generating frequency-domain reference signals 445. The frequency domain reference signals 445 may be noted as $X_r[k,n]$, where r=1 . . . R, the vector of dimension R, representing the time-dependent reference signals in the frequency domain.

The frequency domain reference signals 445 may be processed to reflect the effect of traversal through the acoustic physical path 424 in combination with the diagonalization filtering by 418. This processing may be performed by combining the modeled physical path 424 together with the diagonalization filter matrix 418, with a resultant diagonalized estimated path filter 436. The estimated path filter 436 may be formed according to the equation $\hat{S}_m[k]=\text{diag}(\check{W}_{m,l}[k]\ \hat{S}_{l,m}[k])$, where m=1 . . . M, vector of M, representing the time independent, diagonalized, estimated transfer functions of the acoustic paths in frequency domain. The $\check{W}_{m,l}[k,n]$ quantity may represent the time independent, off-line trained, design solution of the diagonalization filter matrix 418 in the frequency domain, where m=1 . . . M and l=1 . . . L, giving a matrix of M×L. The $\hat{S}_{l,m}[n]$ quantity may represent the time independent, estimated transfer functions of the acoustic paths 424 in the frequency domain. Operator diag( ) is used to extract the diagonal entries, converting the M×M matrix into a vector of dimension M.

The estimated path filter 436 may provide an estimated output signal 438 representing the time dependent, processed frequency-domain reference signals 445 (taking the diagonalization filter matrix 418 into account) in the frequency domain. The estimated output signal 438 may be referred to in the form $\tilde{X}_{r,m}[k,n]$, where r=1 . . . R and m=1 . . . M, with a matrix of R×M.

The error processor 441 may receive the frequency domain error signals 440 and the estimated output signals 438. The error processor 440 may produce error processing output signals 443 in the form $\tilde{E}_{r,m}[k,n]$, representing the time dependent, processed microphone frequency domain error signals 440 (using the estimated output signals 438 based on the frequency-domain reference signals 445), in the frequency domain, where r=1 . . . R and m=1 . . . M, with a matrix of R×M. The error processor 441 may perform processing according to the equation $\tilde{E}_{r,m}[k,n]=\tilde{X}^*_{r,m}[k,n]E_m[k,n]$, where $\tilde{X}^*_{r,m}[k,n]$ is the complex conjugate of $\tilde{X}_{r,m}[k,n]$, and $E_m[k,n]$ represents the time dependent error microphone signals 440 in the frequency domain, where m=1 . . . M, with a vector of dimension M.

The error processing output signals 443 may be provided to a learning algorithm unit (LAU) 444. The LAU 444 may also receive as an input the frequency-domain reference signals 445. The LAU 444 may implement various learning algorithms, such as least mean squares (LMS), recursive least mean squares (RLMS), normalized least mean squares (NLMS), or any other suitable learning algorithm.

Using the received inputs 443 and 445, the LAU 444 generates an LAU output 446. The LAU output 446 may be provided to the adaptive filter 410, to direct the adaptive filter 410 to dynamically adapt to filter the reference signals 402 to produce the desired, anti-noise signals 416 as output. In some cases, the LAU 444 may also receive as input one or more tuning parameters 448. In an example, a tuning parameter 448 of μ[k] may be provided to the LAU 444. The parameter μ[k] may represent the time independent adaptation step size in frequency domain. It should be noted that this is merely one example, and other tuning parameters 448 are possible.

The diagonalization filter matrix 418 groups the speakers with filters, separates the speaker transfer functions zone-by-zone, tunes and decouples the cabin acoustics offline, and adapts for noise cancellation based on independent microphone feedback in real time. This combination of using the diagonalization filter matrix 418 in the multichannel ANC system 400 simplifies cabin acoustic management by diagonalizing a speaker-to-microphone transfer function matrix of the ANC. By combining the diagonalization filter matrix 418 with ANC, the illustrated system 400 separates the noise cancellation effort into (i) offline acoustic tuning, i.e., designing of the diagonalization filter matrix 418, and (ii) real-time adaptation of the decoupled, simplified ANC system 400.

In the offline acoustic tuning and design of the diagonalization filter matrix 418, the diagonalization filter matrix 418 is tuned to group the loudspeakers 422 based on acoustic measurement data of the loudspeakers 422 to microphone 408 transfer functions. One example of designing this diagonalization filter matrix 418 is demonstrated in the Individual Sound Zone (ISZ) functionality described in detail in U.S. Patent Publication No. 2015/350805 as mentioned above. Because this learning session occurs offline, the designing of the diagonalization filter matrix 418 may be performed without pressure on computation time and or runtime computational resources, which enables a comprehensive search for the optimal solution. With the optimal solution of the diagonalization filter matrix 418 being calculated, individual sound zones are then formulated. The loudspeakers 422 are therefore grouped by filters and cooperate in a designed way to deliver the sound at each of the error microphones 408 independently, with minimal interference between zones/error microphones 408.

In the real time adaptive operation, using the loudspeakers 422 as grouped by the diagonalization filter matrix 418, adaptive cancellation filters are decoupled by zones. Using LMS-based control, the system 400 adapts based on independent microphone feedback error signals 426 from each zone, also on the reference signals 402. As opposed to providing outputs for each loudspeaker 422, in this operation one set of adaptive filters 410 only provides one output for each zone. The single zone output is then up-mixed using the pre-tuned diagonalization filter matrix 418, maintaining the loudspeaker 422 cooperation for minimal zone-to-zone interference. This decoupled setting reduces the number of inputs and outputs of adaptive cancellation filters 410, thereby promising faster convergence rate and better cancellation performance.

Thus, by separating the cancellation effort into offline acoustic tuning and real-time adaptation, the system 400 decouples the complex cabin acoustics by constructing the diagonalization filter matrix 418, with adequate search time and computational resource, and simplifies the adaptive cancellation filter system by reducing the input and output channel number. Overall the advantages of faster convergence rate and better cancellation performance are gained.

Furthermore, because the ANC system 400 is decoupled, it is more robust. Performance in one zone has minimal impact on other zones. Failure of any microphone 408 may only cause localized performance degradation constrained in the corresponding seats/zones, maintaining the performance of other seats/zones, due to the fact that the zones are independent from one other.

Figure 5:
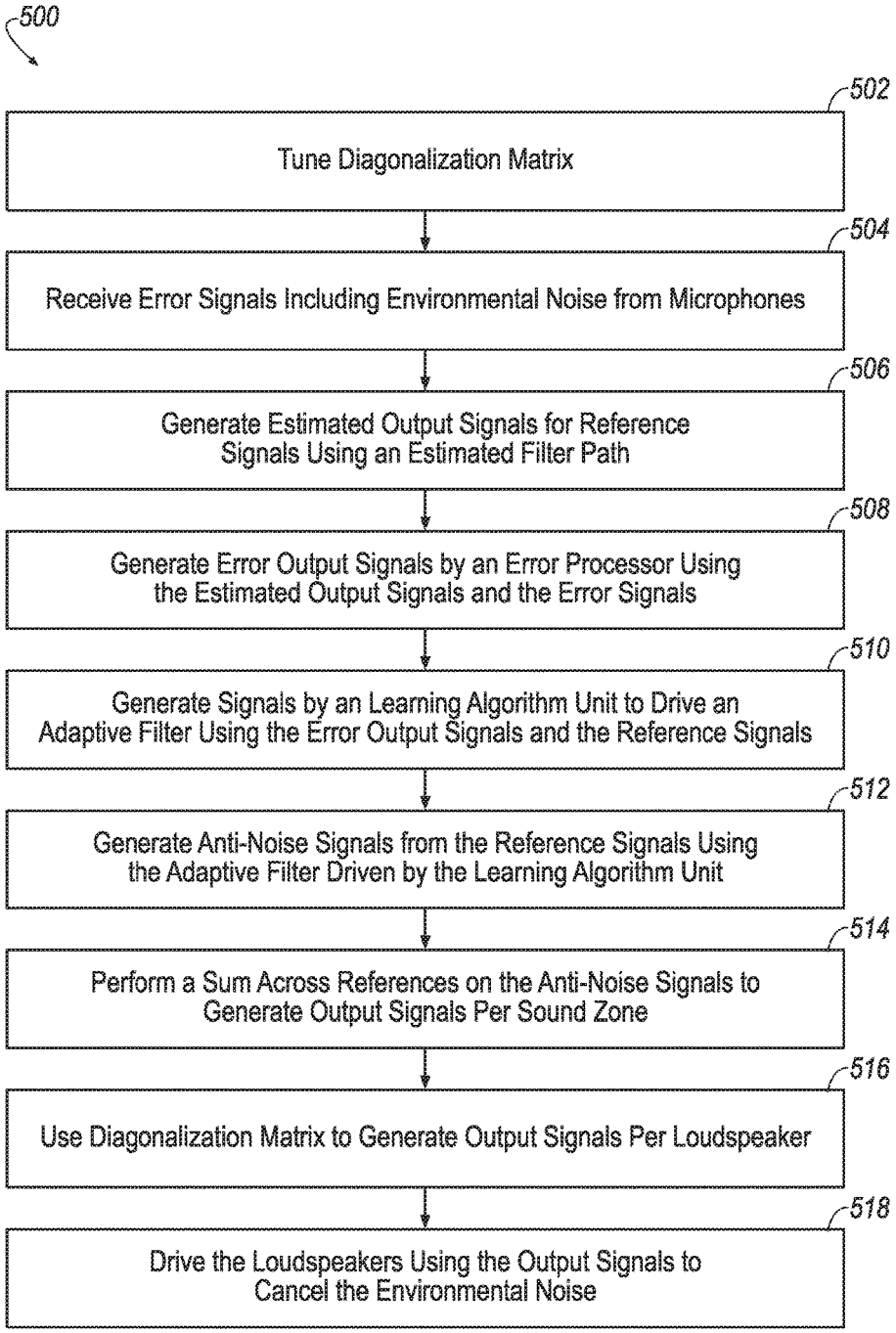
FIG. 5 illustrates an example process for using a diagonalization filter matrix to perform active noise cancellation in an ANC system.

FIG. 5 illustrates an example process 500 for using a diagonalization filter matrix 418 to perform active noise cancellation in a multichannel ANC system 400. In an example, the process 500 may be performed using an audio processor programmed to perform the operations described in detail above with respect to FIG. 4.

At 502, the diagonalization filter matrix 418 is designed and tuned. In the offline acoustic tuning and design of the diagonalization filter matrix 418, the diagonalization filter matrix 418 is tuned to group the loudspeakers 422 based on acoustic measurement data of the loudspeakers 422 to microphone 408 transfer functions. Further aspects of the design and tuning of the diagonalization filter matrix 418 are described above with regard to FIGS. 1-2.

At 504, the audio processor receives error signals 426 generated from microphones 408. The error signals 426 may be generated per sound zone. In an example, each sound zone may include one or more loudspeakers 422 and one corresponding microphone 408.

At 506, the audio processor generates estimated output signals 438 for the reference signals 402 using an estimated path filter 436. In an example, the estimated path filter 436 receives frequency domain reference signals 445 generated by the FFT 442 from the reference signals 402, and uses the estimated function $\hat{S}_m[k]$ to provides an estimated effect on an audio signal radiated by speakers and traversing the acoustic physical path 424 diagonalized by the filter matrix 418.

At 508, the audio processor generates error output signals using an error processor 440, using the estimated output signals 438 and the error signals 426. In an example, the error processor 440 may receive frequency domain error signals 440 generated by the FFT 428 from the error signals 426. The error processor 440 may produce error processing output signals 443 in the form $\tilde{E}_{r,m}[k,n]$ representing the time dependent, processed microphone frequency domain error signals 440 using the estimated output signals 438.

At 510, the audio processor generates LAU output 446 signals using the LAU 444 to drive the adaptive filter 410. In an example, the LAU 444 may receive the error processing output signals 443 and the frequency domain reference signals 445, and may implement various learning algorithms, such as least mean squares (LMS), recursive least mean squares (RLMS), normalized least mean squares (NLMS), or any other suitable learning algorithm to generate LAU output 446 signals that best minimize the environmental noise when processed by the adaptive filter 410.

At 512, the audio processor generates anti-noise signals 416 from the reference signals 402 using the adaptive filter 410 driven by the LAU output 446 of the LAU 444. In an example, the adaptive filter 410 may receive the reference signals 402, and filter the reference signals 402 according to the LAU output 446 to produce the desired, anti-noise signal 416 as output.

At 514, the audio processor performs a sum across references 414 on the adaptive filter 410 outputs to generate anti-noise signals 416 (i.e., per sound zone). In an example, the adaptive filter 410 may provide anti-noise signals 416 per sound zone and per reference signal 402. The sum across references 414 may process these anti-noise signals 416 to provide a single sum for each sound zone.

At 516, the audio processor uses the diagonalization filter matrix 418 to generate output signals per loudspeaker 420 from the anti-noise signals 416. In an example, the anti-noise signals 416 may be provided to the diagonalization filter matrix 418, which may translate the M anti-noise signals 416 into L output signals per loudspeaker 422.

At 518, the audio processor drives the loudspeakers 422 using the output signals per loudspeaker 420 to cancel the environmental noise. The loudspeakers 422 may, accordingly, produce speaker outputs as an acoustical sound wave of the anti-noise to cancel the environmental noise. After operation 516, the process 500 ends.

Computing devices described herein generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, C#, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An active noise cancellation system, using a diagonalization matrix to process anti-noise signals, for cancelling environmental noise in a plurality of sound zones, comprising:

a plurality of sound zones, each including one or more microphones and one or more loudspeakers;

a diagonalization matrix; and an audio processor programmed to:

generate adaptive filter output signals, based on reference signals and feedback error signals through a set of adaptive filters, using an estimated acoustic transfer function that provides an estimated effect on sound waves traversing a physical path, the set of adaptive filters being driven by a learning algorithm unit based in part on the feedback error signals, the reference signals, and the reference signals filtered by the estimated acoustic transfer functions combined with the diagonalization matrix;

perform a sum across references on the adaptive filter output signals to generate a set of anti-noise signals;

process the set of anti-noise signals using the diagonalization matrix to generate a set of output signals per loudspeaker; and drive the loudspeakers using the output signals per loudspeaker to apply the anti-noise signals to cancel the environmental noise in each zone.

2. The active noise cancellation system of claim 1, wherein the learning algorithm unit utilizes a Least Means Square (LMS)-based algorithm to minimize the environmental noise resulting from application of signals from the learning algorithm unit to the adaptive filter.

3. The active noise cancellation system of claim 1, wherein the audio processor is further programmed to receive error signals including the environmental noise from the microphones.

4. The active noise cancellation system of claim 1, wherein the sound zones are seats of a vehicle cabin.

5. The active noise cancellation system of claim 1, wherein the audio processor is further programmed to generate frequency domain reference signals from the reference signals using a Fast Fourier Transform, and to provide the frequency domain reference signals to an estimated path filter and to the learning algorithm unit.

6. The active noise cancellation system of claim 1, wherein the audio processor is further programmed to:

generate frequency domain error signals from the error signals received from the microphones using a Fast Fourier Transform;

provide the frequency domain error signals to an error processor; and use the error processor to generate the feedback error signals from the estimated output signals and the frequency domain error signals.

7. The active noise cancellation system of claim 1, wherein the audio processor is further programmed to provide a tuning parameter to the learning algorithm unit that represents time-independent adaptation step size in frequency domain.

8. The active noise cancellation system of claim 1, wherein the diagonalization matrix is precomputed before runtime of the active noise cancellation system.

9. The active noise cancellation system of claim 1, wherein the diagonalization matrix is designed for a room according to inverting a transfer function matrix including measurements that represent impulse responses for a room in a frequency domain.

10. An active noise cancellation method, using a diagonalization matrix, for cancelling environmental noise comprising:

generating estimated output signals of the reference signals using an estimated filter path transfer function that provides an estimated effect on sound waves traversing a physical path, the estimated filter path transfer function being precomputed and diagonalized based on a modeled acoustic transfer function and the diagonalization matrix, and performing processing according to reference signals;

generating preliminary anti-noise signals from the reference signals using an adaptive filter driven by learning unit signals received from a learning algorithm unit, the learning unit signals based in part on error output signals generated from the estimated output signals, the anti-noise signals including signals per sound zone and per reference signal, each sound zone including a microphone and one or more loudspeakers;

performing a sum across references on the preliminary anti-noise signals to generate a set of anti-noise signals per sound zone;

processing the set of output signals by the diagonalization matrix to generate a set of output signals per loudspeaker; and driving the loudspeakers using the output signals per loudspeaker to apply the anti-noise signals to cancel the environmental noise.

11. The active noise cancellation method of claim 10, further comprising utilizing a Least Means Square (LMS)-based algorithm by the learning algorithm unit to minimize the environmental noise resulting from application of the learning unit signals to the adaptive filter.

12. The active noise cancellation method of claim 10, further comprising receiving error signals including the environmental noise from the microphones.

13. The active noise cancellation method of claim 10, wherein the sound zones are seats of a vehicle cabin.

14. The active noise cancellation method of claim 10, further comprising:

generating frequency domain reference signals from the reference signals using a Fast Fourier Transform; and providing the frequency domain reference signals to the estimated filter path and to the learning algorithm unit.

15. The active noise cancellation method of claim 10, further comprising:

generating frequency domain error signals from the error signals received from the microphones using a Fast Fourier Transform;

providing the frequency domain error signals to an error processor; and using the error processor, generating the error output signals from the estimated output signals and the frequency domain error signals.

16. The active noise cancellation method of claim 10, further comprising providing a tuning parameter to the learning algorithm unit that represents time-independent adaptation step size in frequency domain.

17. The active noise cancellation method of claim 10, wherein the diagonalization matrix is precomputed before runtime of the active noise cancellation system.

18. The active noise cancellation method of claim 10, further comprising designing the diagonalization matrix for a room by measuring a transfer function matrix representing impulse responses for a room in a frequency domain, and inverting the transfer function matrix.

* * * * *